US005086735A

United States Patent [19]

Melchior et al.

[11] Patent Number: 5,086,735

[45] Date of Patent: Feb. 11, 1992

[54] RECIPROCATING INTERNAL COMBUSTION ENGINES OF THE TWO-STROKE TYPE

[75] Inventors: Jean Melchior; Thierry Andre, both of Paris; Henri B. Edelmann, Sevres, all of France

[73] Assignee: S.N.C. Melchior Technologie, France

[21] Appl. No.: 696,745

[22] Filed: May 7, 1991

[30] Foreign Application Priority Data

May 31, 1990 [FR] France ..... 90 06781

[51] Int. Cl.[5] ..... F02B 25/18

[52] U.S. Cl. ..... 123/65 VD; 123/281

[58] Field of Search ..... 123/65 VD, 658, 281, 123/282, 284, 285

[56] References Cited

U.S. PATENT DOCUMENTS 1,158,381 10/1915 Hall ..... 123/65 VD
1,464,282 8/1923 Klossner ..... 123/65 VD
2,587,339 2/1952 Rostu ..... 123/281
4,224,905 9/1980 von Seggern et al. ..... 123/65 WA
4,467,759 8/1984 Artman ..... 123/281
4,543,928 10/1985 von Seggern ..... 123/262
4,854,280 8/1989 Melchior ..... 123/65 VD

FOREIGN PATENT DOCUMENTS 0013180 7/1980 European Pat. Off. ..... 123/65 VD
3143402 5/1983 Fed. Rep. of Germany ..... 123/65 VD

*Primary Examiner*—David A. Okonsky
*Attorney, Agent, or Firm*—Larson and Taylor

[57] ABSTRACT

The two-stroke cycle engine employing intake and exhaust valves comprises a combustion and scavenging prechamber having substantially a shape of revolution about an axis and provided with an intake valve seat. Deflecting means or vanes are disposed inside the intake pipe as directly as possible on the upstream side of the seat so as to urge the mass of air into the combustion chamber in the manner of a whirl.

25 Claims, 6 Drawing Sheets 11
12
10
9
3
15
6
P
2
1
16
5
4

RECIPROCATING INTERNAL COMBUSTION ENGINES OF THE TWO-STROKE TYPE

The invention relates to reciprocating internal combustion engines of the two-stroke cycle type employing intake and exhaust valves and having a combustion and scavenging prechamber, whether these engines have a controlled ignition or a compression ignition.

In modern engines of this type, it is usually attempted to improve the operation:

a) by increasing the permeability of the cylinder, i.e. by allowing through the air flow required by the engine, under a pressure difference between intake and exhaust and/or with a simultaneous opening duration of the intake and exhaust valves which is as small as possible;

b) by decreasing the short circuiting of air between the intake and the exhaust by an orientation of the current of fresh air particles entering the cylinder which prevents them from passing directly from the intake to the exhaust, thereby improving the efficiency of the scavenging;

c) by preventing as far as possible the fresh air admitted in the course of a cycle into the cylinder from becoming mixed during the scavenging with burnt gases coming from the preceding cycle and leaving the cylinder through the exhaust port or ports; and d) for a non-homogeneous combustion and compression ignition engine, by creating in the combustion chamber intense motions of air which are well synchronized with the fuel injection so as to improve the mixture between the air and fuel.

In order to ensure a centrifugal stratification of the combustion, it has already been proposed in U.S. Pat. No. 4,224,905 to organize the circulation of the air admitted into the cylinder in such manner that this air undergoes in each cycle, inside the cylinder, a helical motion about an axis substantially coincident with the axis of the cylinder, but the structure proposed in this document is complicated since it requires arranging that the prechamber open into the cylinder in a tangential direction in such manner that the air is introduced tangentially in the plane of the cylinder head, and providing a central exhaust valve and an intake valve which directly supplies the prechamber as well as in general two additional intake valves opening into the cylinder and located on each side of the central exhaust valve.

An object of the invention is to organize a helical circulation of the air admitted into the cylinder which ensures simultaneously the reduction in the air short circuit and the formation of a whirl in the combustion chamber. Another object of the invention is to arrange a two-stroke cycle reciprocating engine employing valves in such manner that the criterion b) defined above is particularly well respected by shifting the particles of fresh air introduced into the cylinder away from the exhaust port or ports, bearing in mind the orientation of the paths imposed on these particles. A further object of the invention is to improve the two-stroke cycle engines described in U.S. Pat. No. 4,854,280 and will be chosen hereinafter for defining the prior art.

For this purpose, the invention provides a two-stroke cycle internal combustion engine which comprises:

at least one cylinder devoid of lateral ports;

a combustion chamber defined in this cylinder by a cylinder head which is fixed relative to the cylinder and by a piston undergoing a reciprocating motion inside this cylinder;

a combustion and scavenging prechamber provided in the cylinder head, including an intake valve seat and communicating with the combustion chamber through a transfer passage having an outlet which opens into the combustion chamber and has a cross-section perpendicular to the axis of the cylinder which is an oblong surface and is internally substantially tangent to the inner wall of the cylinder;

an intake valve having an axis which is at least approximately orthogonal to the axis of the cylinder and is preferably secant with respect to the last-mentioned axis, and being so disposed that the stem of this valve is spaced further away from said last-mentioned axis than the head of the valve and this head is movable inside said prechamber for the purpose of moving away from and toward said intake valve seat;

an intake pipe which directly leads to the upstream side of said seat; and at least one exhaust valve disposed in such manner that its axis is at least approximately parallel to the axis of the cylinder and it is capable of cooperating, while allowing passage of the exhaust gases on at least the major part of its periphery, with an exhaust valve seat provided in the ceiling of the cylinder head opposite the transfer passage, the last-mentioned seat being preferably so arranged that the transverse surface of the head of the piston only leaves at top dead centre the required operational clearance with the exhaust valve and the ceiling of the cylinder head, characterized in that the prechamber, apart from its connection with the transfer passage, has substantially a shape of revolution about an axis which is parallel to the axis of the intake valve and preferably substantially coincident with the last-mentioned axis or slightly offset relative to the latter;

deflecting means, disposed inside an end part of the intake pipe, i.e. as directly as possible on the upstream side of the seat of the intake valve, are so arranged as to produce a deflection in a single sense about the axis of said intake valve, of the mass of air which arrives through this pipe when said intake valve is open; and the transfer passage has such shape that, on one hand, the deflection thus produced in the prechamber by the deflecting means during the scavenging stage creates a substantially helical swirling in the cylinder and, on the other hand, upon the rising of the piston, said substantially helical swirling creates in turn in the prechamber a swirling in the same direction.

In other words, it may be said that the swirling induced in the cylinder during the scavenging creates a swirling in the prechamber during the compression stage. One is therefore in the presence of a swirling created in the prechamber for the combustion stage which is not reversed during the expansion, in contrast to known structures such as the "RICARDO" prechamber.

The aforementioned deflecting means, which may be formed by the very design of the intake pipe on the upstream side of the seat but which are preferably formed by vanes, may be connected either to the intake valve in that they are disposed with clearance inside the end part of the intake pipe, this intake valve then comprising guide means preventing it from rotating about itself, or to the seat of the intake valve in that they surround with clearance the stem of this valve.

The prechamber preferably has a height (i.e. a dimension parallel to said axis) which is substantially equal to the travel of the intake valve. It is advantageous, although not necessary, to give to the whole of the prechamber and transfer passage a shape which is substantially symmetrical relative to a plane containing the axis of the cylinder and the axis of the intake valve and to give to the transfer passage a shape which facilitates the creation of the swirling in the cylinder during the scavenging and the induction of a swirling in the prechamber during the compression.

Note that, in contrast to said U.S. Pat. No. 4,224,905, the introduction of the air into the cylinder is not tangential with respect to the central intake valve, but the particles of air introduced in this way are directed obliquely downwardly so as to deviate their path and move them away from the vicinity of the exhaust.

As will be explained in more detail hereinafter with reference to the drawings, the engine according to the invention attains the objects of the latter.

The invention will now be described in more detail with the aid of these drawings, in which.

Figure 2:
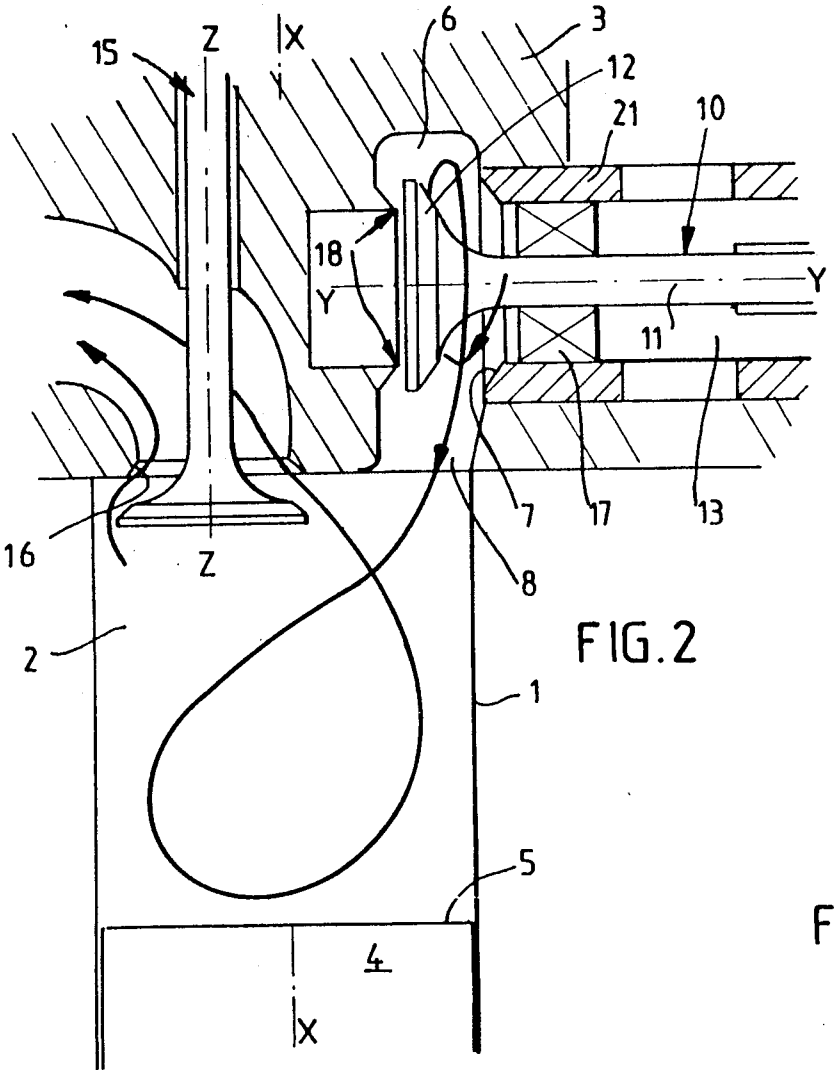
Figure 4:
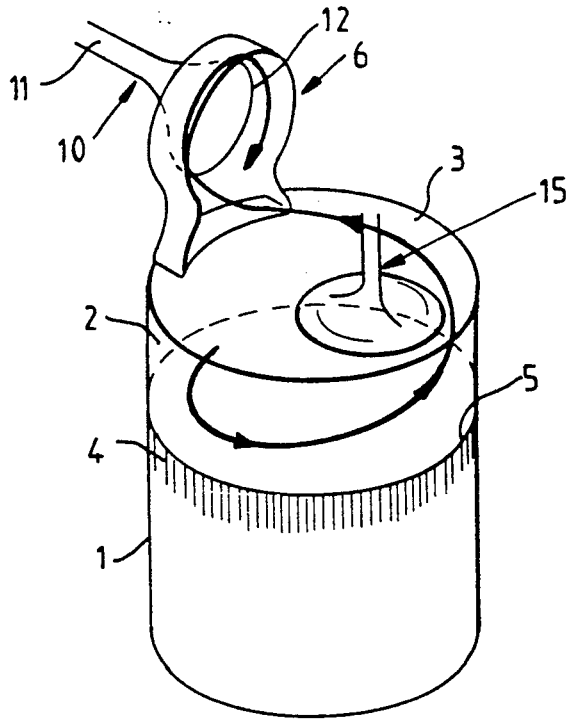
FIGS. 4 to 6 are views similar to that of FIG. 1 but respectively correspond to the compression, the combustion and the expansion.
Figure 9:
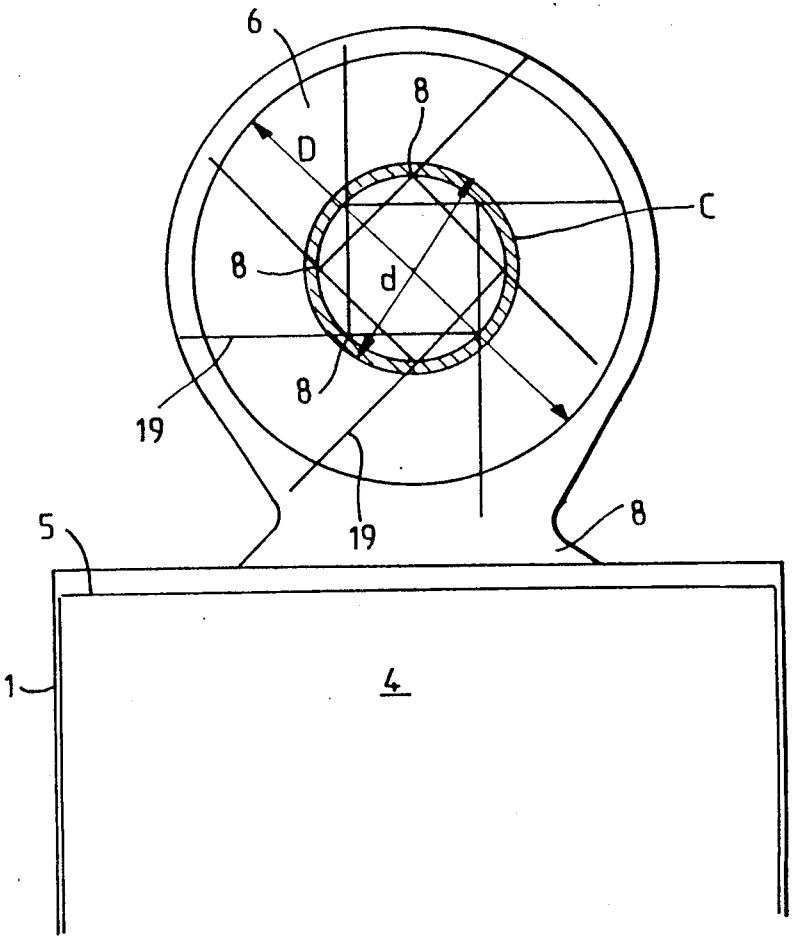
Figure 8:
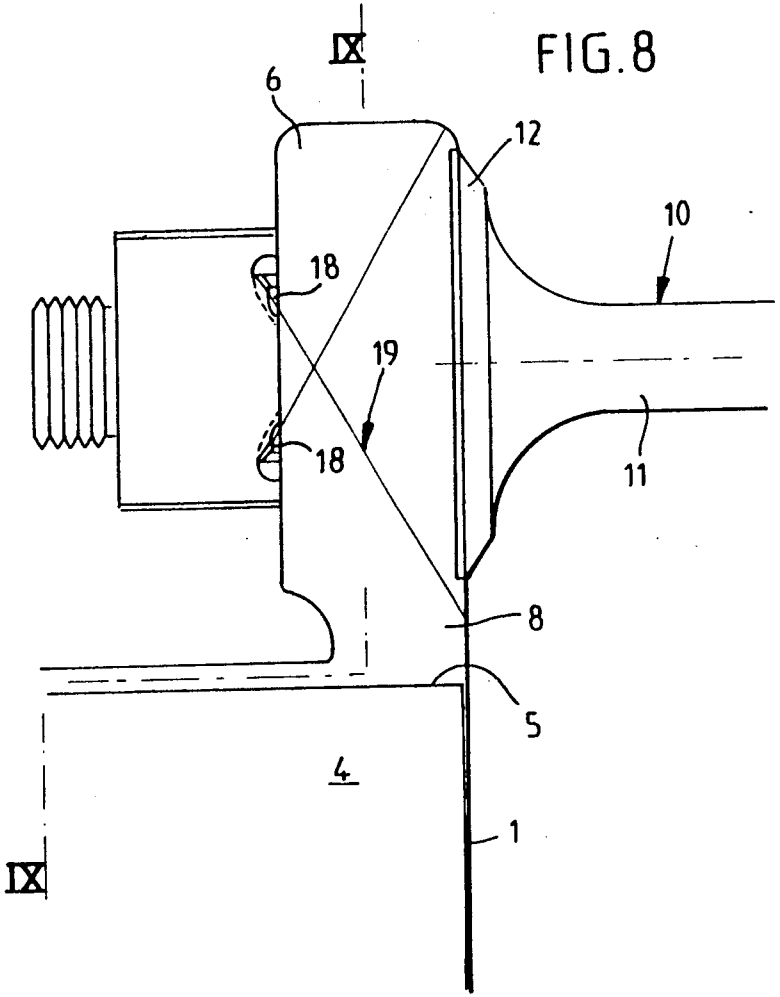
Figure 11:
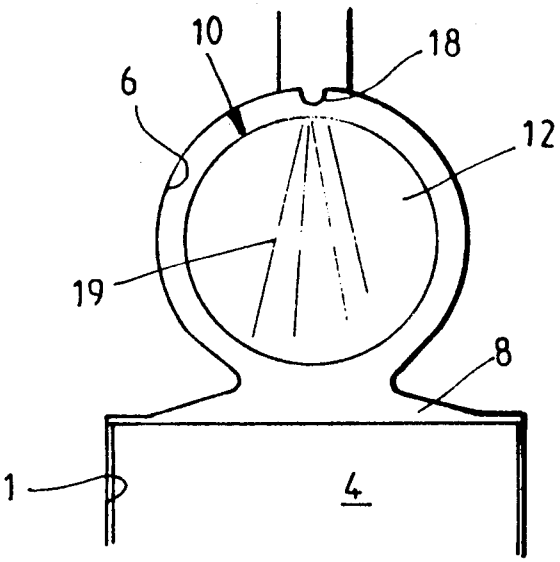
Figure 10:
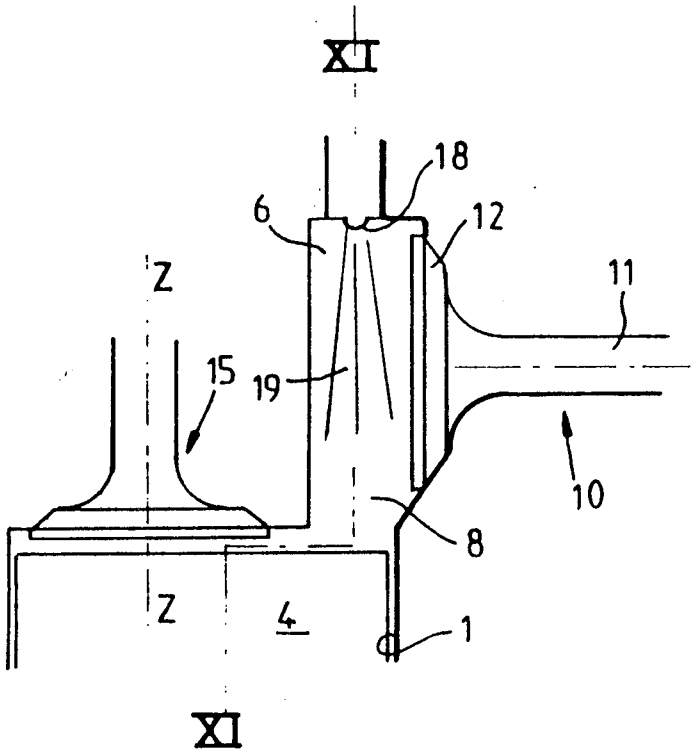

FIGS. 8 and 9 represent diagrammatically a fuel supply system established in accordance with a first variant, respectively by a view similar to a part of FIG. 2 and a section taken on line IX—IX of FIG. 8; and FIGS. 10 and 11 represent diagrammatically a fuel supply system established in accordance with a second variant, respectively by views similar to those of FIGS. 8 and 9, FIG. 11 being a sectional view taken on line XI—XI of FIG. 10.

Figure 1:
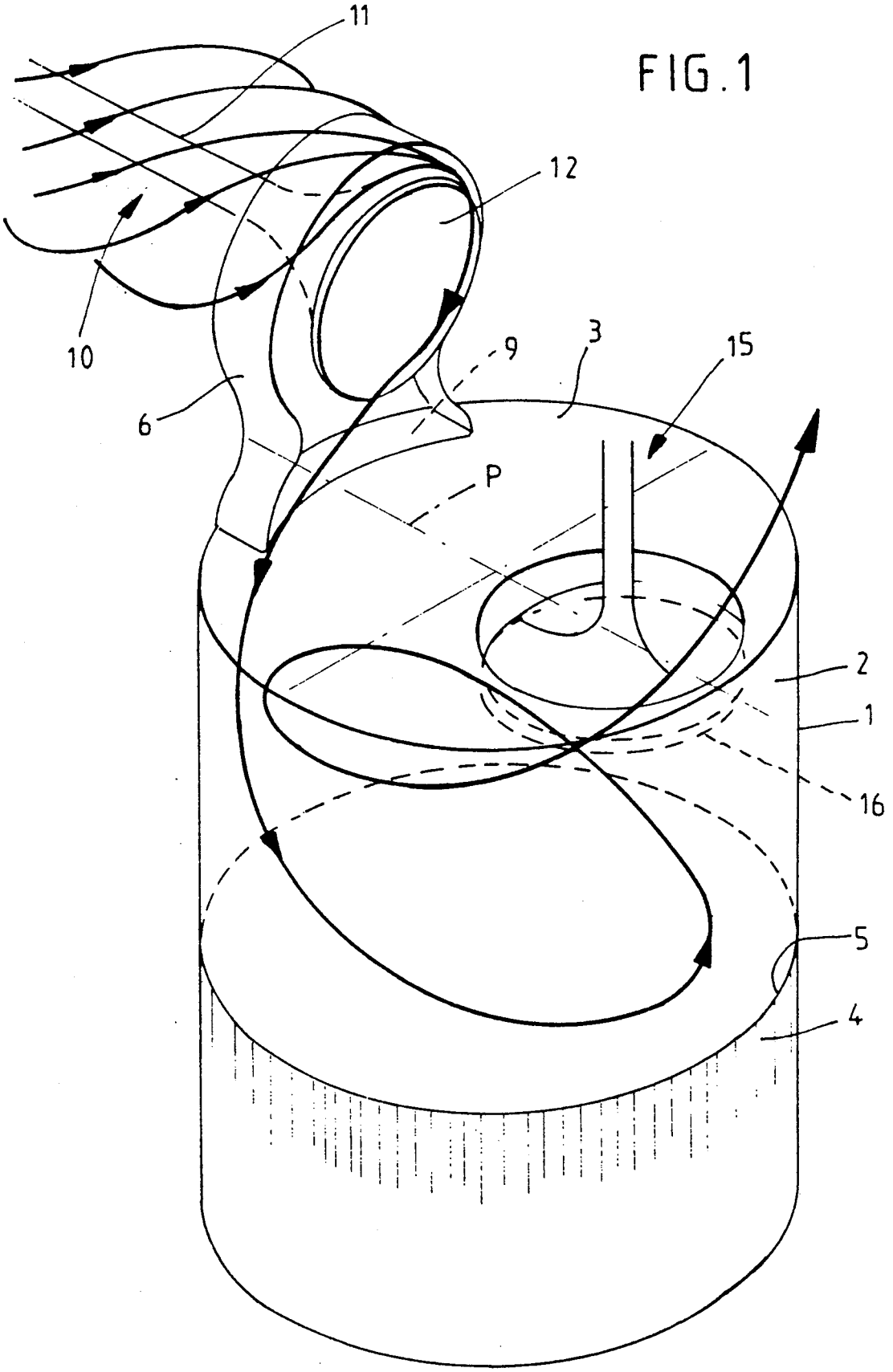
FIGS. 1 to 3 are diagrammatic views of an engine according to the invention in positions occupied by the piston and the valves in the course of the scavenging, respectively in perspective, and to a reduced scale, in section through the plane P (FIG. 3) containing the axes of the cylinder and of the intake and exhaust valves and in a plane perpendicular to the last-mentioned plane.
Figure 3:
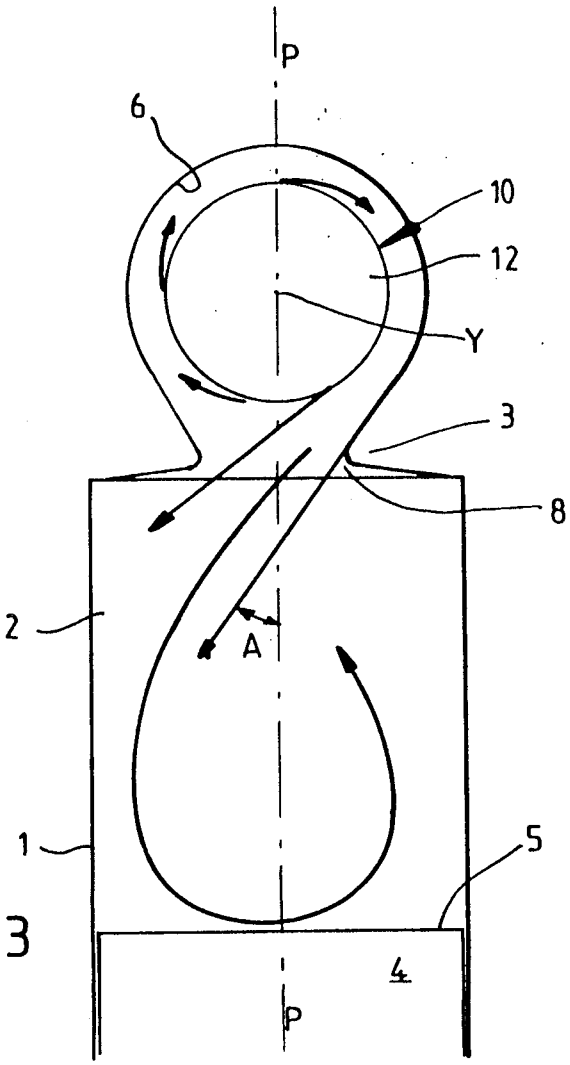
Figure 7:
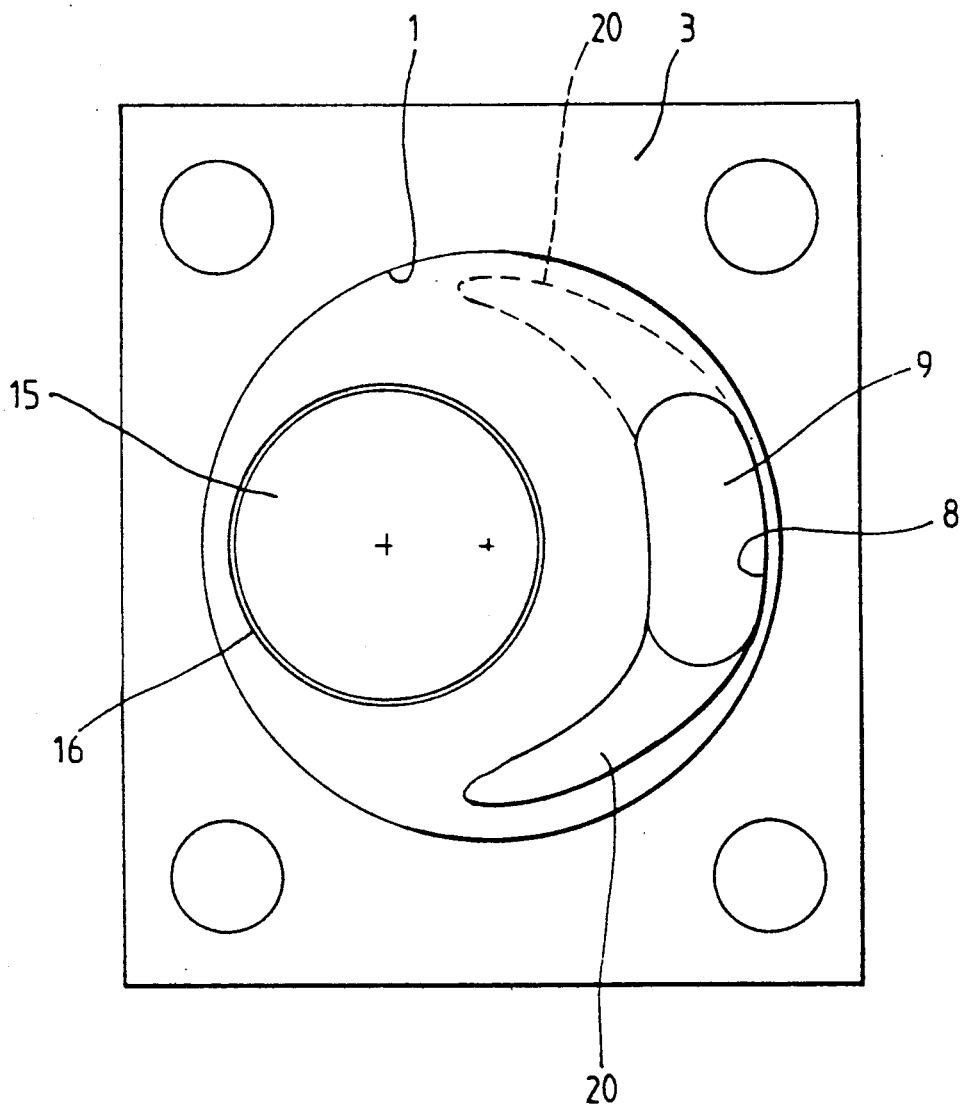
FIG. 7 is a diagrammatic view of the cylinder head of the engine seen from the lower end of FIG. 2.

The engine shown in FIGS. 1 to 3 comprises:

at least one cylinder 1 devoid of lateral ports;

a combustion chamber 2 defined in the cylinder 1 by a cylinder head 3 fixed with respect to the cylinder 1 and by the transverse surface 5 of a piston 4 undergoing a reciprocating motion inside the cylinder 1;

a combustion and scavenging prechamber 6 formed in the cylinder head 3, provided with an intake valve seat 7 (FIG. 2) and communicating with the combustion chamber 2 through a transfer passage 8 having an outlet which opens into the combustion chamber 2 and has a section perpendicular to the axis X—X of the cylinder 1 which is an oblong surface 9 internally substantially tangent to the inner wall of the cylinder 1 roughly parallel to the large dimension of this oblong surface, as shown in FIG. 7;

an intake valve 10 whose axis Y—Y is at least approximately orthogonal to the axis X—X of the cylinder 1 and preferably secant with respect to the axis X—X, this intake valve 10 being disposed in such manner that its stem 11 is further away from the axis X—X than the head 12 of the valve 10 and this head 12 is movable inside the prechamber 6 for the purpose of moving away from and toward the seat 7;

an intake pipe 13 which leads directly to the upstream side of the seat 7;

at least one exhaust valve 15 so disposed that its axis Z—Z is at least approximately parallel to the axis X—X of the cylinder 1 and it is capable of cooperating, while allowing passage of the exhaust gases on at least the major part of its periphery, with a seat 16 provided in the ceiling of the cylinder head 3 opposite the transfer passage 8, the last-mentioned seat 16 being preferably arranged in such manner that the transverse surface 5 of the head of the piston 4 allows to subsist at top dead centre (FIG. 5) only the required operational clearance with the exhaust valve 15 and the ceiling of the cylinder head 3, the exhaust valve 15 or all of the exhaust valves (when there are more than one) being preferably at least approximately symmetrical relative to the plane P (FIG. 3) containing the axis X—X of the cylinder 1 and the axis Y—Y of the intake valve 10. Note that this plane P is coincident with the plane of FIG. 2.

An engine such as that described heretofore with reference to the Figures is known from the aforementioned U.S. Pat. No. 4,854,280.

This being so, according to the invention, the prechamber 6 is given, apart from its connection with the transfer passage 8, substantially a shape of revolution about an axis parallel to the axis Y—Y of the intake valve 10 and preferably substantially coincident with the axis Y—Y or slightly offset from the latter, and deflecting means 17 are disposed inside the end part of the intake pipe 13, i.e. as directly as possible on the upstream side of the seat 7, and are so arranged as to produce a deflection, in a single direction about the axis Y—Y, of the mass of air which arrives through the pipe 13 when the intake valve 10 is opened.

Further, the transfer passage 8 has such shape that, on one hand, the deflection produced in this way in the prechamber 6 by the deflecting means 17 during the scavenging stage creates a substantially helical swirling in the cylinder 1 and, on the other hand, upon the rising of the piston 4, said substantially helical swirling creates in turn in the prechamber 6 a swirling in the same sense.

Although they may be formed by a special geometry of the intake pipe 13, for example of helical or "corkscrew" shape, the deflecting means 17 are usually constituted by vanes and may be in this case connected either to the valve 10 (arrangement not shown), these means being disposed with clearance inside the end part of the intake pipe 13, in which case the valve 10 comprises guide means preventing it from turning about itself, or to the seat 7, the deflecting means surrounding with clearance the stem 11 of the valve 10 as diagrammatically represented in FIG. 2.

The whole of the prechamber 6 and transfer passage 8 preferably has a substantially symmetrical shape with respect to a plane parallel to the axis X—X of the cylinder 1 and containing the axis Y—Y of the intake valve 10, preferably with respect to the plane P.

Preferably, only a single exhaust valve 15 is associated with the cylinder 1. The transverse surface 5 of the piston 4 and the ceiling of the cylinder head 3 are preferably planar (apart from the groove or grooves 20 mentioned hereinafter) and perpendicular to the axis X—X of the cylinder 1.

The lips of the transfer passage 8 are advantageously so arranged that the jet of air issuing from the prechamber 6 toward the cylinder 1 makes an angle A of the order of 30° with the plane parallel to the axis X—X of the cylinder 1 and containing the axis Y—Y of the intake valve 10 (see FIG. 3). This angle A obviously depends on the rate of deflection of the mass of air passing through the seat 7 of the intake valve 10 after having passed through the deflecting means 17 and on the shape of the transfer passage 8. The magnitude of this angle will preferably change in a way contrary to that of the stroke/bore ratio. If this angle A is excessive, the paths of the air particles will not enter sufficiently deeply into the combustion chamber 2 toward the piston 4 and will remain too close to the exhaust valve or valves, which tends to cause a direct passage from the intake to the exhaust, to the detriment of the quality of the scavenging. On the other hand, if this angle A is too small, the air particles have a tendency to be sent back by the piston 4 toward the exhaust port or ports, which produces the same harmful effect. The optimum situation is that obtained at around an angle of 30° for a stroke/bore ratio of the order of 1.25.

As shown in FIG. 3, the transfer passage 8 preferably has a shape which is convergent toward the outlet at which it opens into the cylinder 1 and, again preferably, substantially symmetrical with respect to said plane parallel to the axis X—X of the cylinder 1 and containing the axis Y—Y of the intake valve 10, and is flared at its connection with the cylinder 1, thereby preferably having Ω section.

The geometry of the intake valve 10 prevents placing the latter in position through the ceiling of the cylinder head. It is therefore advisable to associate in the known manner with this intake valve 10 a valve case or pocket 21 (FIG. 2) which permits placing the valve 10 in position with its seat 7 by passing through the cylinder head 3 (i.e. from the right to the left as viewed in FIG. 2).

As shown in FIG. 7, it is advantageous to form in the piston 4 or preferably in the part of the cylinder head 3 which is outside the outlet (or oblong surface) 9 at which the transfer passage 8 opens into the cylinder, and outside the seat 16 of the exhaust valve 15, at least one groove 20 which leads to the outlet 9 and has a cross-section and/or depth which decrease in the direction away from this outlet 9. This groove (as shown in full line), or each of these grooves (as shown in full line and in dotted line), advantageously has a semi-crescent shape.

In the case of a compression ignition engine, the injection orifice or orifices 18 may be placed in the prechamber 6 either on the lateral wall of the latter, in front of the intake valve 10 and preferably arranged on at least one circle centred on the axis of the prechamber 6, or on the peripheral wall of the latter.

Figure 5:
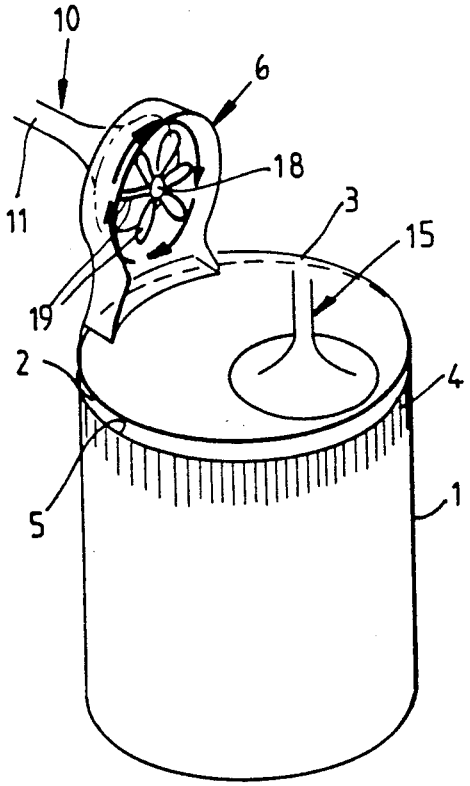
Figure 6:
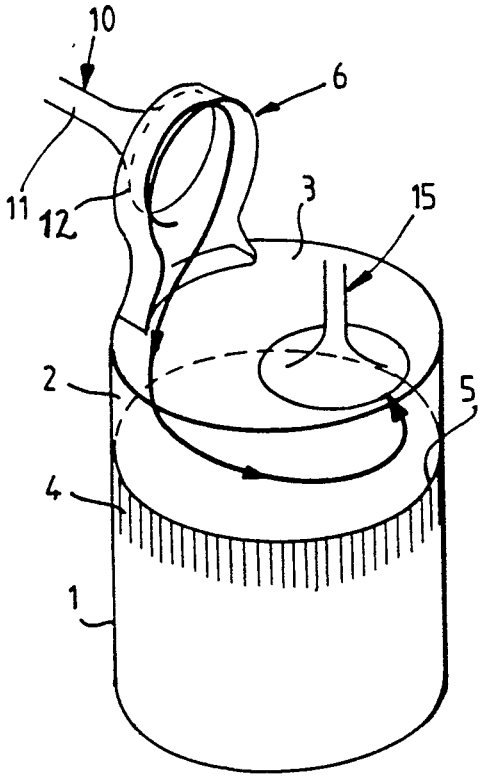

In a first arrangement, there may be only one annular injection orifice 18 centred on the axis of the prechamber, as diagrammatically represented in FIG. 2, or a plurality of orifices arranged on a circle centred on the axis of the prechamber and oriented radially toward the periphery of the latter, as diagrammatically represented in FIG. 5. But it seems preferable, in order to increase the distance allowed to the fuel between the orifice or orifices 18 and the wall, as shown in FIGS. 8 and 9, to provide a plurality of injection orifices 18, for example eight orifices, advantageously spaced apart along one (as illustrated) or a plurality of circles C preferably centred on the axis of the prechamber 6. These injection orifices are advantageously oriented toward the periphery of the prechamber 6, as is clear from FIG. 8, in the manner of one of the families of the generatrices of a hyperboloid of revolution. In the (illustrated) case where these orifices 18 are spaced apart along a single circle C, the latter advantageously has a diameter d of the order of 50% of the diameter D of the prechamber 6.

In the second arrangement diagrammatically illustrated in FIGS. 10 and 11, preferably only a single sheet-type injection orifice 18 (nipple injector) is provided which is located on the top of the prechamber 6, i.e. on the part of the peripheral wall of the latter opposite the transfer passage 8. This injection orifice 18 which discharges in the direction toward the transfer passage 8 is then oriented in such manner that the jet or sheet of fuel 19 issuing therefrom is located in a plane substantially perpendicular to the axis of the prechamber 6.

According to either one of these arrangements (FIGS. 8 to 11), an improved homogeneity of the air/fuel mixture is obtained and, by favouring the initiation of the combustion on the periphery of the prechamber 6, the harmful formation of a hot zone in the vicinity of the injection orifice is avoided.

There is in this way provided an engine which operates as follows, the arrows in FIGS. 1 to 6 diagrammatically representing the motions of the fluids inside the cylinder 1 and at the entrance and at the outlet of the latter. During scavenging (FIGS. 1 to 3), with the piston 4 first of all in the vicinity of bottom dead centre, then during the first part of its rise, the air passing through the seat 7 is deviated by the deflecting means 17, the intake valve 10 and the walls of the prechamber 6 so as to enter the cylinder 1 in the form of a jet which is inclined with respect to the axis X—X of the cylinder 1 (in the manner of a whirl). Owing to the cylindrical shape of the cylinder, the paths of the air particles emerge obliquely from the prechamber 6 and curl in the shape of a helix inside the cylinder 1, which has for effect to prevent these particles from passing in proximity to the seat 16 of the exhaust valve 15 which is then open. Owing to the absence of a short circuit, the efficiency of utilization is high and a good thermal homogeneity of the piston 4 and cylinder 1 (or the sleeve of the latter) is obtained.

In the compression stage (FIG. 4), the helical rotational motion induced in the cylinder 1 during the scavenging stage is maintained during the rising of the piston 4 which tends to reduce the pitch of the helix.

The air pushed by the rising piston 4 enters the prechamber 6 while maintaining the tangential velocity induced by the rotation in the cylinder 1, which causes the rotation of the air in the prechamber 6 coaxially of said prechamber and, which is important, without reversing the direction of the rotation induced in the prechamber 6 in the course of the scavenging.

In the combustion stage (FIG. 5), the quasi-totality of the air enclosed in the cylinder 1 is pushed by the squish effect of the piston 4 cooperating with the ceiling of the cylinder head 3 and with the exhaust valve 15 bearing against its seat 16, inside the prechamber 6 while maintaining its rotational motion coaxial with said prechamber. In the preferred case of a diesel engine, the injection orifice or orifices 18 spray fuel jets 19 which interfere with the rotational motion of the air and in this way facilitate the mixture between the air and fuel. It is for the purpose of limiting the velocity of transfer of the gases from the principal chamber 2 to the prechamber 6 and vice versa, that said groove or grooves 20 are advantageously provided preferably in the cylinder head 3 and not in the piston 4, in particular when the piston 4 has the possibility of rotating about its axis in operation (in the case for example of a spherical articulation of the piston 4 with the associated connecting rod), as shown in FIG. 7.

In the expansion stage (FIG. 6), there is produced a phenomenon which is the opposite of that of the compression, the gases leaving the prechamber 6 with an inclination similar to that which was produced during the scavenging.

By this mechanism, the rotation of the air and of the gases is maintained without reversal of the direction both in the cylinder 1 and in the prechamber 6. For each scavenging cycle, the rotational motion is reactivated by the deflecting means 17 acting on the admitted fresh air. In this way there is obtained an aerodynamic situation which results in the minimum of losses since there will be a reacceleration in each cycle without reversal of the direction of the flows.

In the foregoing it was assumed that the engine had only a single cylinder, but it will be obvious that the explanations given hereinbefore remain valid in the case where the engine has two or more cylinders. Likewise, although the engine according to the invention has been described hereinbefore to comprise a single exhaust valve 15, it could comprise two or even more exhaust valves. Although FIG. 3 represents a prechamber 6 having a shape of revolution about an axis coincident with the axis Y—Y of the intake valve 10, the axis of the prechamber 6 could be slightly offset from the axis Y—Y.

The invention is applicable in a particularly advantageous manner to engines turbocharged by a turbo-compressor unit driven by the exhaust gases.

What is claimed is:

1. In a two-stroke internal combustion engine which comprises:

at least one cylinder having an axis and an inner wall and devoid of lateral ports;

a cylinder head having a ceiling and fixed relative to said cylinder and a piston disposed inside said cylinder for undergoing reciprocating motion inside said cylinder, a combustion chamber being defined in said cylinder by said cylinder head and said piston;

a combustion and scavenging prechamber provided in said cylinder head, an intake valve seat provided in said prechamber, a transfer passage putting said prechamber chamber in communication with said chamber through an outlet at which outlet said transfer passage opens into said combustion chamber, said outlet having a cross-section perpendicular to said axis of said cylinder which is an oblong surface internally substantially tangent to said inner wall of said cylinder;

an intake valve comprising a head and a stem and having an axis which is at least substantially orthogonal to said axis of said cylinder and so disposed that said stem of said intake valve is spaced further away from said axis of said cylinder than said head of said intake valve and said head is movable inside said prechamber for the purpose of moving away and toward said intake valve seat;

an intake pipe which leads directly to an upstream side of said first intake valve seat; and at least one exhaust valve seat provided in said ceiling of said cylinder head opposite said transfer passage, at least one exhaust valve which has an axis and is so disposed relative to said cylinder that said axis of said at least one exhaust valve is at least substantially parallel to said axis of said cylinder and is capable of cooperating, while allowing passage of exhaust gases on at least a major part of the periphery of said at least one exhaust valve, with said at least one exhaust valve seat;

the improvement wherein said prechamber has, apart from the connection thereof with said transfer passage, substantially a shape of revolution about an axis parallel to said axis of said intake valve;

deflecting means are disposed inside an end part of said intake pipe as directly as possible on an upstream side of said intake valve seat and are so arranged as to produce a deflection in a single direction about said axis of said intake valve, of the mass of air which arrives through said passage when said intake valve is open; and said transfer passage has such shape that the deflection thus produced in said prechamber by said deflecting means during a scavenging stage produces a substantially helical swirling in said cylinder and, when said piston rises in said cylinder, said substantially helical swirling in turn produces in said prechamber a swirling in the same direction.

2. Engine according to claim 1, wherein said axis of said intake valve is secant with respect to said axis of said cylinder.

3. Engine according to claim 1, wherein said piston has a tranverse head surface and said exhaust valve seat is so arranged that the transfer head surface of said piston allows at top dead centre only the required operational clearance with said exhaust valve and said ceiling of said cylinder head.

4. Engine according to claim 1, wherein said axis about which said prechamber is a shape of revolution is substantially coincident with said axis of said intake valve.

5. Engine according to claim 1, wherein said deflecting means comprise vanes disposed around said stem of said intake valve.

6. Engine according to claim 5, wherein said vanes are connected to said intake valve and are disposed with a clearance inside an end part of said intake pipe, guide means being provided for cooperation with said intake valve for preventing said intake valve from rotating about itself.

7. Engine according to claim 5, wherein said vanes are connected to said intake valve seat and surround said stem of said intake valve with clearance.

8. Engine according to claim 1, wherein said prechamber has a height which is substantially equal to the travel of said intake valve in operation.

9. Engine according to claim 1, wherein said transfer passage has a shape which converges toward said outlet.

10. Engine according to claim 9, wherein said transfer passage is substantially symmetrical relative to a plane parallel to said axis of said cylinder and containing said axis of said intake valve.

11. Engine according to claim 1, wherein the whole of said prechamber and transfer passage has a shape which is substantially symmetrical relative to a plane parallel to said axis of said cylinder and containing said axis of said intake valve.

12. Engine according to claim 1, wherein said cylinder has only one exhaust valve.

13. Engine according to claim 1, comprising at least one injection orifice opening into said prechamber through which at least one orifice said engine is supplied with fuel, said at least one injection orifice being located in a lateral wall of said prechamber opposite said intake valve.

14. Engine according to claim 13, wherein said at least one injection orifice is located in a lateral wall of said prechamber opposite said intake valve coaxially with respect to said prechamber.

15. Engine according to claim 13, wherein said at least one injection orifice is oriented toward the periphery of said prechamber.

16. Engine according to claim 15, comprising a plurality of injection orifices spaced apart on at least one circle centred on said axis of said prechamber.

17. Engine according to claim 15, comprising a plurality of said injection orifices which are spaced apart on a single circle having a diameter which is of the order of 50% of the diameter of said prechamber.

18. Engine according to claim 1, comprising an injection orifice opening into said prechamber for supplying fuel to said engine, said injection orifice being located on a peripheral wall of said prechamber which is opposite said transfer passage.

19. Engine according to claim 18, wherein said injection orifice is oriented toward said transfer passage.

20. Engine according to claim 1, wherein said piston has a tranverse surface and said transfer surface and said ceiling of said cylinder head are substantially planar and perpendicular to said axis of said cylinder.

21. Engine according to claim 1, wherein said transfer passage has lips which are so arranged that a jet of air emerging from said prechamber toward said cylinder makes an angle of the order of 30° with a plane parallel to said axis of said cylinder and containing said axis of said intake valve, when the ratio between the stroke and the bore of said engine is of the order of 1.25.

22. Engine according to claim 1, comprising, in said piston at least one groove which leads to said outlet and has a cross-section and/or depth which decrease as one moves away from said outlet.

23. Engine according to claim 1, comprising, in a part of said cylinder head which is outside said outlet of said transfer passage and outside said exhaust valve seat at least one groove which leads to said outlet and has a crosssection and/or a depth which decrease as one moves away from said outlet.

24. Engine according to claim 1, comprising a valve case associated with said intake valve and said intake valve seat.

25. Engine according to claim 1, which is supercharged.

* * * * *